United States Patent [19]

Beck

[11] Patent Number: 4,528,714

[45] Date of Patent: Jul. 16, 1985

[54] ADJUSTABLE PAINT ROLLER

[75] Inventor: Earl Beck, Orangevale, Calif.

[73] Assignee: In. Ex. Painting, Orangevale, Calif.

[21] Appl. No.: 574,336

[22] Filed: Jan. 27, 1984

[51] Int. Cl.[3] ..... B05C 17/02

[52] U.S. Cl. ..... 15/230.11; 15/144 R; 29/110.5

[58] Field of Search ..... 15/144 R, 230.11; 403/97; 29/110.5, 116 R

[56] References Cited

U.S. PATENT DOCUMENTS

| | | | |
|---|---|---|---|
| 3,273,192 | 9/1966 | Mazzella | 15/144 R X |
| 3,336,703 | 8/1967 | Multer | 15/144 R X |
| 3,419,931 | 1/1969 | Willig | 15/230.11 X |

*Primary Examiner*—Edward L. Roberts

*Attorney, Agent, or Firm*—Mark C. Jacobs

[57] ABSTRACT

A manual, angularly adjustable paint roller wherein the roller frame can be disposed at an angle of choice as opposed to the standard 90° angle relative to the handle.

5 Claims, 4 Drawing Figures

ADJUSTABLE PAINT ROLLER

FIELD OF THE INVENTION

This application pertains to paint rollers for the application of paint and more particularly to an angularly adjustable paint roller.

BACKGROUND OF THE INVENTION

Commercial painting in the last ten (10) years has switched primarily from brush to roller application. This change over has occurred for several reasons. Firstly rollers don't leave brush strokes. Secondly more paint can be applied in each dip of the roller than in a dip of the brush into the paint tray. Thirdly rollers are easier to use.

Rollers, too, have their disadvantages. For instance, it is still necessary to use a brush to do the top of a wall, i.e., the interface with the ceiling, if one doesn't want to get paint on the ceiling. Secondly on gable roof buildings, dormers, etc., the angularly disposed boards are difficult to paint with rollers, due to the fact that arm muscles get tired quickly when the operator is working at an angle that differs from the vertical or horizontal.

There is a need, therefore, for an adjustable paint roller that will permit the operator to do wall tops, angled boards and other hard to reach areas.

It is an object, therefore, of this invention to provide an angularly adjustable paint roller.

It is another object of this invention to provide a paint roller wherein the head is manually adjustable.

It is a further object to provide an improved paint roller wherein the angle of the head can be set relative to the handle.

These and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention, reference should be had to the following detailed description taken in connection with the accompanying drawings.

SUMMARY OF THE INVENTION

A manually adjustable paint roller is disclosed wherein the head angle can be preset relative to the handle.

DESCRIPTION OF THE PREFERRED EMBODIMENT

Figure 1:
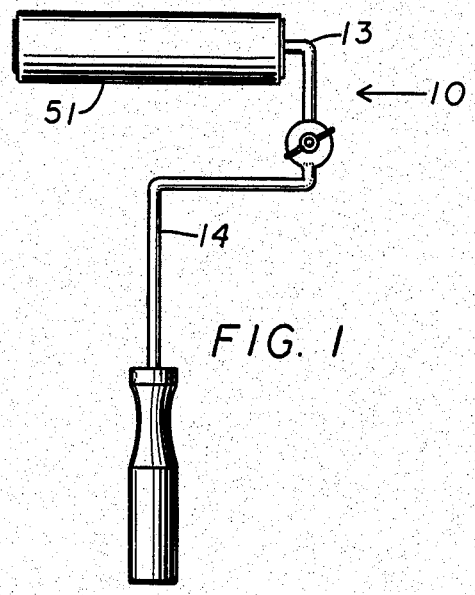
FIG. 1 is a top perspective view of the device of this invention.
Figure 2:
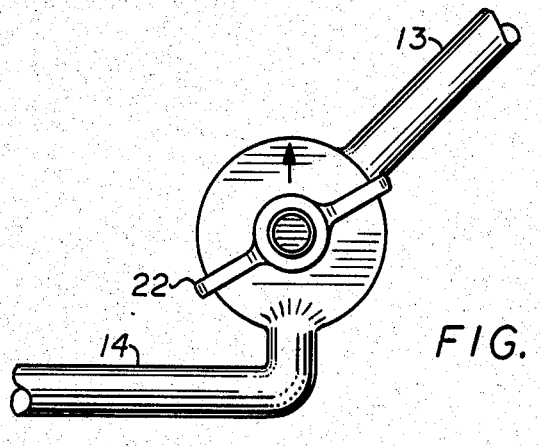
FIG. 2 is a top plan view of the adjustment means of this invention.

In FIG. 1 is seen the paint roller frame namely device 10 that constitutes this invention. The components thereof are best seen in the exploded view in FIG. 3 and the operative mode is shown in FIG. 2 wherein the assemblage of FIG. 3 is depicted.

Figure 3:
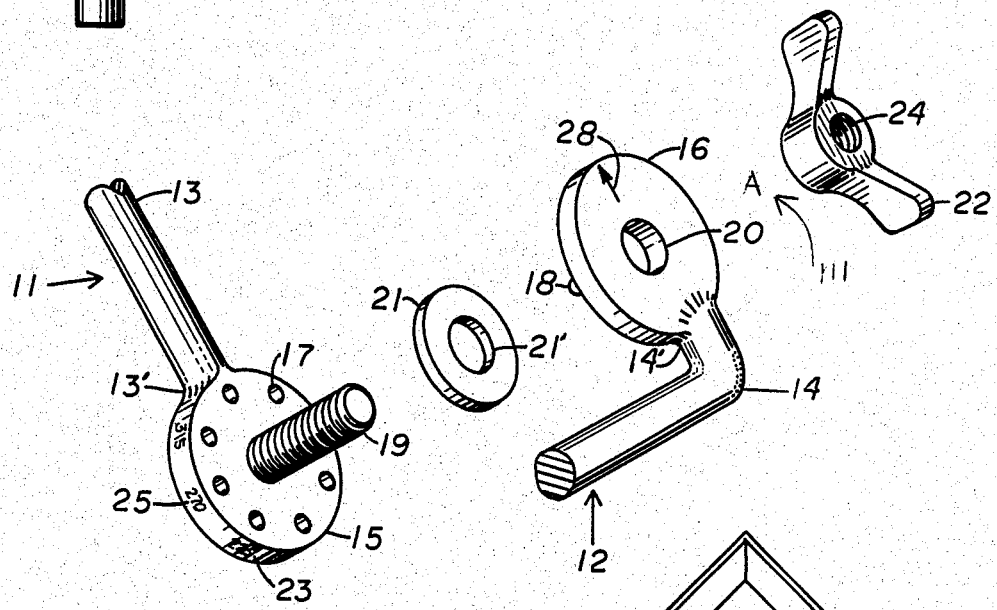
FIG. 3 is a perspective exploded view of the FIG. 2 means.

Turning to FIG. 3, top portion 11 includes top arm 13 to which is attached the roller mechanism 51 on one end, and base plate 15 on the other end. Plate 15 is disposed axially in line with the end of the arm 13'. Base plate 15 includes a plurality of preferably eight (8) vertical bores 17 spaced 45° apart—though twelve (12) 30° bores can also be employed—spread around the periphery of the base plate. Base plate 15 is preferably round though a multisided one can be used with equal facility. Edge 23 of plate 15 can optionally include indicia 25 corresponding to the angles of the spaced bores. In the center of the base plate 15 is a normally disposed upstanding threaded shaft 19 which is secured to said plate by welding, adhesing or other conventional attachment means.

The use of threaded partial bore to receive the said threaded shaft is also contemplated. If desired, one may employ a washer 21 having a central aperture 21' is disposed upon shaft 19. Washer 21 is sized such that its diameter is less than the diameter of a hypothetical circle tangential to the innermost point of all of the spaced bores of base plate 15. This prevents any impediment to the bores for reasons to be discussed.

Handle portion or bottom portion 12 includes lower arm 14 a top plate 16 and a pair of 180° opposed, spaced bosses 18 on the underside 16 of said top plate near the periphery thereof. An arrow 28, or other indicia is marked or etched into the top side 16T preferably 90° between the two bosses 18. Plate 16 includes a central bore 20 sized to receive shaft 19. Plate 16 is in axial allgnment with arm 14 and secured to one end thereof. A wing nut or other nut 22 having a central threaded bore 24 threads onto shaft 19.

While two bosses are shown in the 3rd figure, 3 or even more can be used with equal facility on the underside of plate 16. Both plates 15 and 16 are preferably of similar diameter, and configured as circular discs.

When the device is assembled as shown in FIG. 1, the angle of the top portion 11 to the lower portion 12 is fixed. It is seen that the angle can be set at for instance 45° as shown in FIG. 2 by loosening the wing nut 22, raising the bosses 18 from their engagement in apertures 17 and then re-engaging them in apertures corresponding to a different angle, as may be desired.

It is readily seen that the adjustment means can also be made in reverse fashion, with the bores in the top plate and the bosses extending upwardly from the base plate, if such is desired.

Each plate can be formed integral with or attached to end 13' and 14' of the respective top and handle portions.

Figure 4:
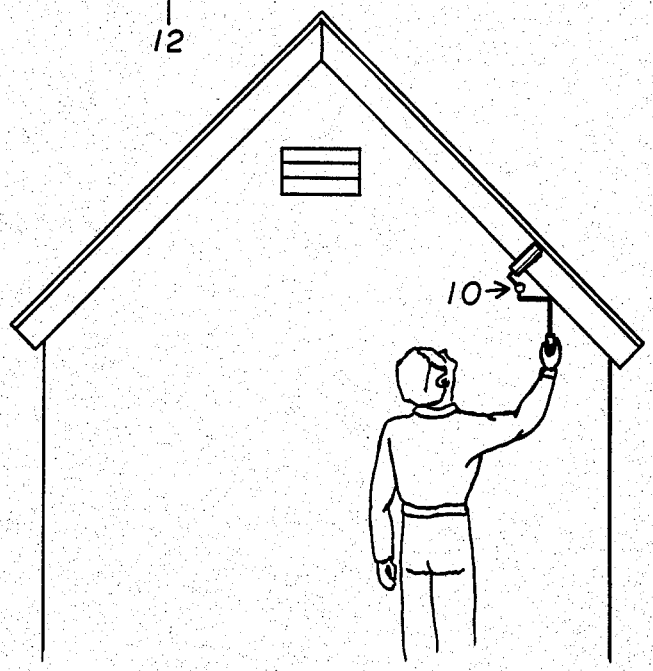
FIG. 4 is a front view showing the use of the instant device on a gable roof.

FIG. 4 illustrates the use of the instant device as on a gable roof of a barn, where without the instant device scaffolding would have been necessary to obtain angled hand use of the roller at a short distance from the arm in order to ensure user hand comfort. This is due to the fact that at the oblique angle, the operator couldn't hold the roller for the extended period of time required to do the job.

Washer 21 may also be employed at location "A" as shown by the arrow 111, namely between the wingnut 22 and plate 16. While a standard washer such as 21 may be so employed, a lock washer would be preferred at this location.

It is seen that the two plates may be made of any convenient structural material such as metal or plastic.

The bosses may be made of the same or different material. Mention may be made of steel, aluminum, magnesium, Delrin®, nylon, or polycarbonate. The balance of the device may be made of conventional materials usually used for paint rollers.

In conclusion we have disclosed a tool that makes painting of ceiling interfaces and angled surfaces much easier and therefore cheaper for the consumer. The instant tool can be made to sell at a reasonable price, competitive with other less flexible paint rollers. The angle between the roller and the handle can be set at any angle of choice, not just the standard 90°.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A paint roller device having the angle of the roller relative to the handle selectable by the user, said paint roller device comprising:

a first portion and a second portion, interconnected by an angularly selectable connecting means, said first portion including a roller head and a top arm, said top arm extending outwardly from said roller arm slightly and then normally away from said roller arm to a base plate, which comprises part of the connecting means, said base plate having a plurality of spaced apertures around the periphery thereof, and having an upstanding threaded shaft centrally disposed normal to said plate;

said second portion including a handle and a lower arm, said lower arm having a first section emanating from said handle, a second section normal to said first section, and a third section normal to said second section directed away from said first section and terminating in a cover plate, which comprises part of the connecting means, said cover plate having opposed bosses on the underside thereof sized and spaced for engagement with spaced apertures of said base plate and a central bore adapted to receive the threaded shaft of said base plate, the plates of said connecting means being matingly engaged whereby said top arm and said lower arm lie in a plane, a threaded nut secured upon said threaded shaft over said cover plate to retain said plates in engagement.

2. In the device of claim 1 wherein said base plate and said cover plate are both circular discs.

3. In the device of claim 1 wherein the connecting means is made of steel.

4. In the device of claim 1 wherein a washer is interposed between said plates.

5. The device of claim 1 wherein angle indicating indicia is marked on the cover plate.

* * * * *